US009605687B1

(12) United States Patent
Zauhar et al.

(10) Patent No.: US 9,605,687 B1
(45) Date of Patent: Mar. 28, 2017

(54) AUTOMATIC LOCKING DOWNWARD COUPLER FOR CEILING FAN

(71) Applicant: Chien Luen Industries Co., Ltd., Inc., Oakland Park, FL (US)

(72) Inventors: Zachary Zauhar, Dania Beach, FL (US); Eliezer Rivera, Plantation, FL (US); Tien S. Lowe, Cooper City, FL (US)

(73) Assignee: Chien Luen Industries Co., Ltd., Inc., Oakland Park, FL (US)

( * ) Notice: Subject to any disclaimer, the term of this patent is extended or adjusted under 35 U.S.C. 154(b) by 396 days.

(21) Appl. No.: 14/273,625

(22) Filed: May 9, 2014

Related U.S. Application Data

(60) Provisional application No. 61/823,514, filed on May 15, 2013.

(51) Int. Cl.

| | |
|---|---|
| ***F04D 29/64*** | (2006.01) |
| ***F04D 25/08*** | (2006.01) |
| *F21V 21/13* | (2006.01) |
| *F21V 21/00* | (2006.01) |
| *F21V 21/02* | (2006.01) |

(52) U.S. Cl.
CPC ..... *F04D 29/646* (2013.01); *F04D 25/088* (2013.01); *F21V 21/00* (2013.01); *F21V 21/02* (2013.01); *F21V 21/13* (2013.01)

(58) Field of Classification Search
CPC ..... F21V 21/13; F21V 21/00; F21V 21/02; F04D 25/088; F04D 29/646
USPC ..... 248/343; 362/382–456; 416/5, 244 R
See application file for complete search history.

(56) References Cited

U.S. PATENT DOCUMENTS

| | | | | | |
|---|---|---|---|---|---|
| 4,531,179 | A * | 7/1985 | Baker | F21V 21/02 | 362/294 |
| 4,592,702 | A * | 6/1986 | Bogage | F04D 25/088 | 310/89 |
| 4,697,777 | A * | 10/1987 | Yang | F16M 11/041 | 248/343 |
| 4,714,230 | A | 12/1987 | Huang | | |
| 4,729,725 | A | 3/1988 | Markwardt | | |
| 4,810,207 | A | 3/1989 | Butterfield | | |
| 5,090,654 | A | 2/1992 | Ridings | | |
| 5,134,554 | A * | 7/1992 | Donato | F21S 8/06 | 362/254 |
| 5,462,412 | A * | 10/1995 | Scofield | F04D 29/384 | 248/343 |
| 5,507,619 | A | 4/1996 | Ryan | | |
| 6,017,190 | A | 1/2000 | Lackey | | |
| 6,116,559 | A * | 9/2000 | Lackey | F04D 25/088 | 248/343 |
| 6,196,804 | B1 | 3/2001 | Lackey | | |
| 6,488,439 | B1 * | 12/2002 | Lackey, Sr. | F04D 25/088 | 403/305 |
| 6,752,218 | B2 * | 6/2004 | MacDonald, III | A62C 35/68 | 169/16 |

(Continued)

*Primary Examiner* — Michael R Reid
*Assistant Examiner* — Christopher Ballman
(74) *Attorney, Agent, or Firm* — Brian S. Steinberger; Law Offices of Brian S. Steinberger, P.A.

(57) ABSTRACT

Devices, apparatus, systems and methods of coupling a downrod to a ceiling fan motor where a threadable coupling arrangement includes a spring that automatically locks the motor to the downrod after the motor is threadably attached to the downrod. A set screw/pin can be used for extra security to further lock the coupler to the down rod.

13 Claims, 4 Drawing Sheets

(56) References Cited

U.S. PATENT DOCUMENTS

| | | | | |
|---|---|---|---|---|
| 7,080,813 | B1 * | 7/2006 | Frampton | F04D 25/088<br>248/342 |
| 2003/0190183 | A1 | 10/2003 | Hsing | |
| 2004/0115062 | A1 * | 6/2004 | Pearce | F04D 29/601<br>416/244 R |
| 2011/0033309 | A1 * | 2/2011 | Chen | F04D 25/088<br>416/244 R |
| 2011/0052411 | A1 * | 3/2011 | Yamamoto | F04D 25/08<br>416/244 R |

* cited by examiner

AUTOMATIC LOCKING DOWNWARD COUPLER FOR CEILING FAN

This application claims the benefit of priority to U.S. Provisional patent application Ser. No. 61/823,514 filed May 15, 2013, the entire disclosure of which is incorporated by reference in its' entirety.

FIELD OF INVENTION

This invention relates to ceiling fans, and in particular devices, apparatus, systems and methods of coupling a downrod to a ceiling fan motor where a threadable coupling arrangement includes a spring that automatically locks the motor to the downrod after the motor is threadably attached to the downrod.

BACKGROUND AND PRIOR ART

Downrods are popular to allow ceiling fans to hang substantially lower from a ceiling. To attach the downrod often requires the installer to screw the top of the ceiling fan motor into a lower end of the downrod as shown and described in relation to U.S. Pat. No. 6,017,190 to Lackey. Another technique is to have use a cotter type pin to insert through mateable holes in both a coupling socket on top of the fan motor and into side opening(s) along the lower end of the downrod, as shown and described in U.S. Pat. Nos.: 4,729,725 to Markwardt and 4,810,207 to Butterfield.

Merely screwing the fan motor housing to the downrod may not be sufficient to keep the fan from detaching from the downrod. For example, the constant vibration of the ceiling fan in operation can cause the ceiling fan to detach from the down rod overtime. An uncoupling of the fan can cause damage to the fan itself and further cause serious harm to persons underneath the fan.

Using cotter type pins to connect the downrod to the ceiling fan motor also has problems. For example, the installer having to line up the side opening in the female socket coupler to the side opening in the downrod which can be time consuming and difficult, especially if the installer is trying to raise the motor over their head to attach it to a pre-mounted downrod. Similar to the threaded arrangement, the motor can become detached over time if the cotter pin becomes loose and falls out of the connection point and can become lost. A pin may allow for a loose fit attachment, where the motor may be loosely attached to the downrod causing undesirable vibration noise to occur when the fan is running.

Thus, the need exists for solutions to the above problems with the prior art.

SUMMARY OF THE INVENTION

A primary objective of the present invention is to provide devices, apparatus, systems and methods of coupling a downrod to a ceiling fan motor where a threadable coupling arrangement includes a spring that automatically locks the motor to the downrod after the motor is threadably attached to the downrod.

A secondary objective of the present invention is to provide devices, apparatus, systems and methods of coupling a downrod to a ceiling fan motor which does not easily become detached overtime.

A third objective of the present invention is to provide devices, apparatus, systems and methods of easily coupling a downrod to a ceiling fan motor without using tools and loose pins.

A fourth objective of the present invention is to provide devices, apparatus, systems and methods of coupling a downrod to a ceiling fan motor in a vibration free tight fit arrangement.

A novel motor housing attached coupler with internal threads can be configured to be mated with a corresponding downrod with external threads so that the downrod threads into the female socket portion of the novel coupler.

The invention can use a downrod with external threads and at least one cavity drilled near the end of the rod The coupler can have a spring clip attached to the outside of the coupler, facing inward. Once the downrod is being threaded into the coupler, the spring clip will automatically engage with a side hole in the downrod when aligned it becomes aligned.

Once the spring clip has engaged through the outside of the coupler and inside of downrod cavity, the downrod will not be able to unthread itself.

An additional set screw can be used for extra security to further lock the coupler to the down rod.

Further objects and advantages of this invention will be apparent from the following detailed description of the presently preferred embodiments which are illustrated schematically in the accompanying drawings.

DESCRIPTION OF THE PREFERRED EMBODIMENTS

Figure 1:
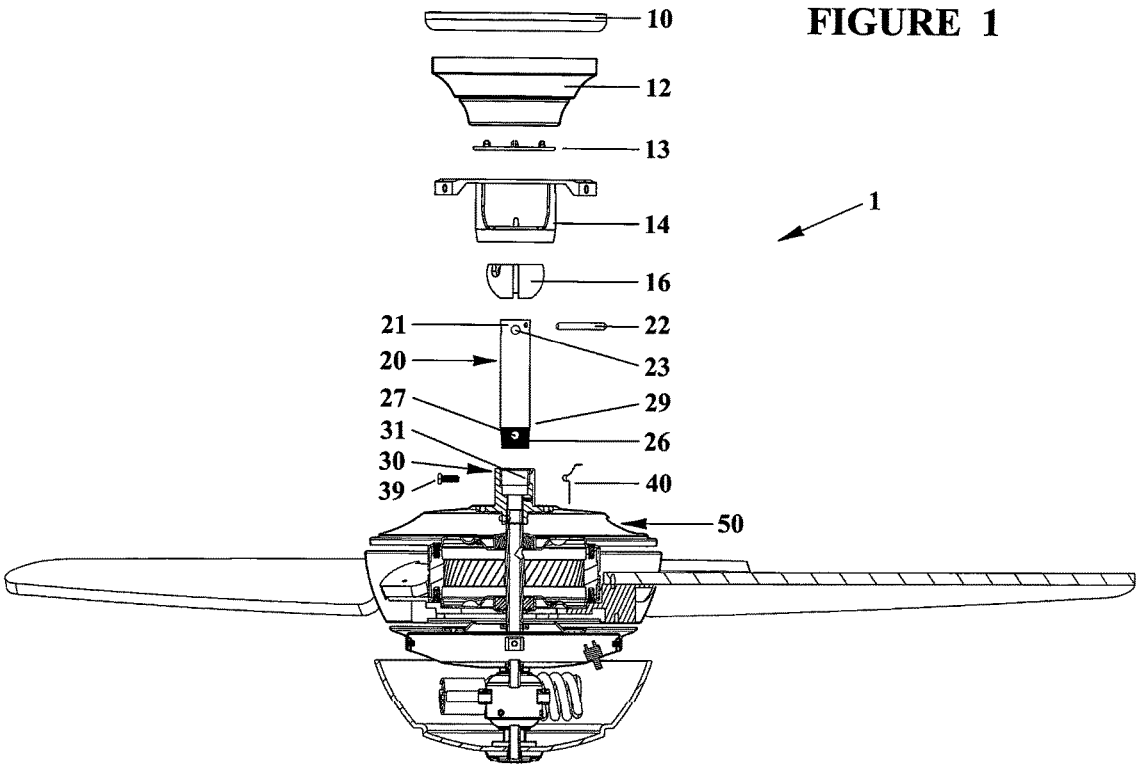
FIG. 1 shows an exploded cross-sectional view of a ceiling fan with attached coupler spaced from a downrod and a ceiling fan canopy.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A listing of the components is described below.

1. Ceiling fan
10. Ceiling ring
12. canopy
13. plate
14. upper coupler
16. ball
20. downrod
21. upper end
22. upper pin/screw/fastener
23. pin hole
26. threaded lower end
27. side hole for screw
29. side opening for clip
30. coupler for motor housing
31. internal threads
32. side hole for screw
34. side opening for clip
37. nut under base
38. base of coupler
39. side pin/screw/fastener
40. spring clip
42. tab end
44. bent portion
46. leg
48. fastener though leg
49. side screw
50. motor housing with fan blades FIG. 1 shows an exploded cross-sectional view of a ceiling fan 1 with attached novel coupler 30 spaced from a downrod 20 and a ceiling fan canopy 12.

Figure 2:
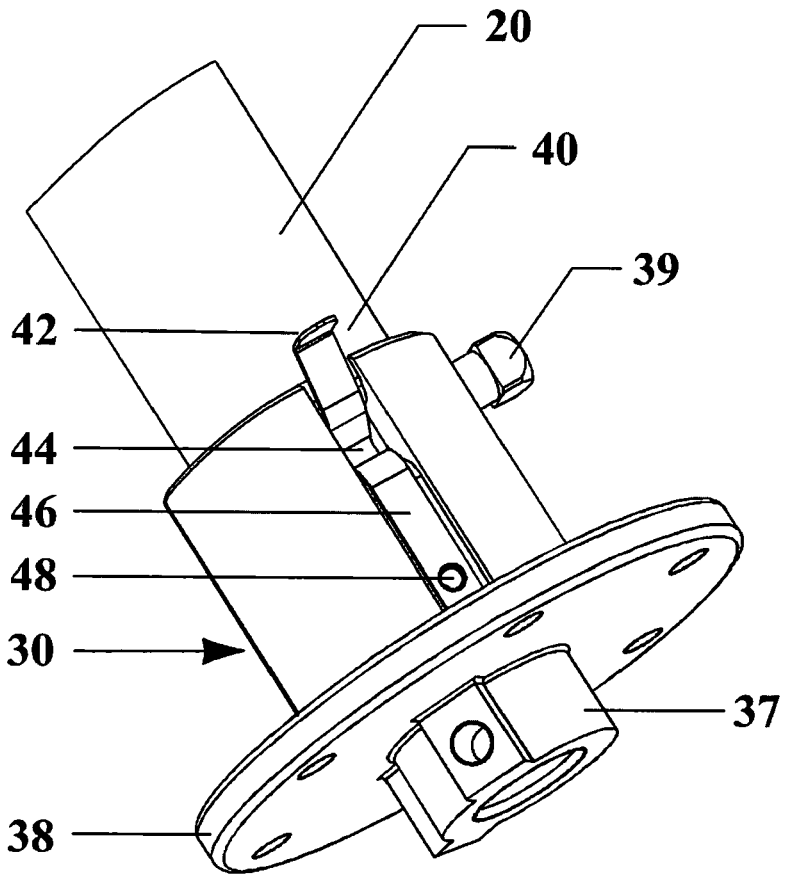
FIG. 2 is a perspective view of the novel downrod coupler of FIG. 1.

FIG. 2 is a perspective view of the novel downrod coupler 30 of FIG. 1 attached to the lower end of the downrod 20.

Figure 3:
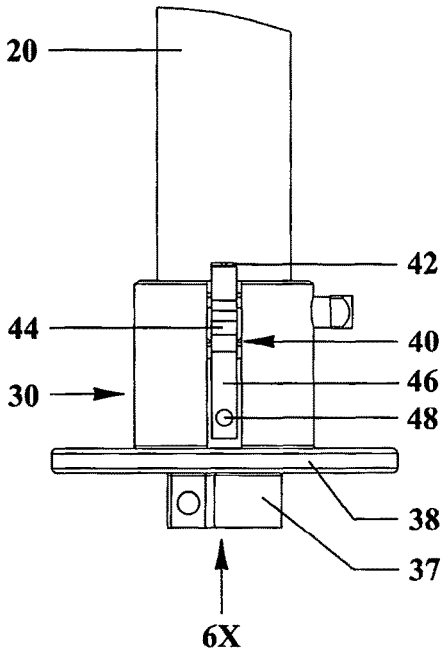
FIG. 3 is a front view of the downrod coupler of FIG. 2.
Figure 4:
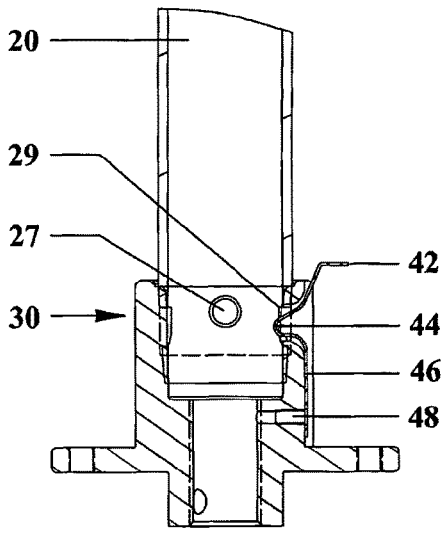
FIG. 4 is a cross-sectional view of the downrod coupler of FIG. 3.
Figure 5:
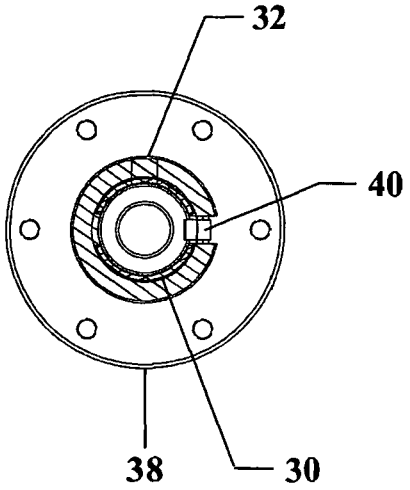
FIG. 5 is a cross-sectional view of the downrod coupler of FIG. 4 along arrow B.
Figure 6:
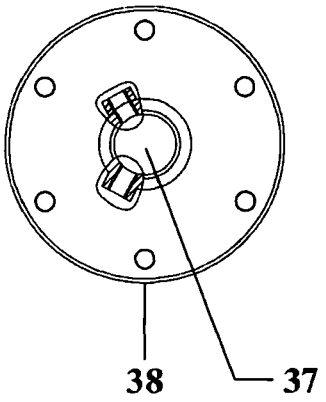
FIG. 6 is a bottom partial ghost view of the downrod coupler of FIG. 3 along arrow 6X.

FIG. 3 is a front view of the downrod coupler 30 with attached downrod 20 of FIG. 2. FIG. 4 is a cross-sectional view of the downrod coupler with attached downrod 20 of FIG. 3. FIG. 5 is a cross-sectional view of the downrod coupler 30 of FIG. 4 along arrow B. FIG. 6 is a bottom partial ghost view of the downrod coupler 30 with attached downrod 20 of FIG. 3 along arrow 6X.

Referring to FIG. 1, the invention can be used with a ceiling fan 1 having a traditional ceiling ring 10 that attaches to a ceiling on an upper side, and a lower side having a canopy 12 with lower plate 13 that attaches to an upper coupler 14. A ball 16 attached to the lower portion of the upper coupler 14 is also attached to an upper end 21 of a downrod 20 with pin/fastener 22 inserted through a pin hole 23, which are known features in the prior art.

The downrod 20 with lower threaded end 26 and side hole 27 for pin/screw 39 is modified to have an additional side opening 29 for use with the novel spring clip 40.

Referring to FIGS. 1-6, the novel lower coupler 30 can include an upper opening having internal threads 31 for mateably receiving the exterior threaded end 26 of the downrod 20. Lower coupler 30 can include a side hole 32 for receiving pin/screw 39, and a side opening 34 for receiving the bent portion 44 of the spring clip 40. On the bottom of the coupler 30 can be an enlarged base 38 with nut 37 that attaches to the motor housing 50 of the ceiling fan 1.

The spring clip 40 can include an upper outwardly protruding tab end 42 an inwardly bent portion 44. A lower vertical leg 46 attaches the spring 40 to the side of the coupler 30 by a fastener 48, such as a pin or screw.

The invention can be practiced after the ceiling ring with canopy 12, plate 13, upper coupler 14 with ball 16 and upper end 21 of downrod 20 have been installed in place to suspend below a ceilng. An installer can quickly and securely attach the downrod 20 to the ceiling fan motor 50 using the novel coupler 30 that has been pre-attached to the motor 50.

The installer can thread the lower end 26 of the downrod 20 into the internal threads 31 in the top of the coupler 30. The inwardly bent portion 44 on the leg 46 of the spring clip 40 is biased to press into the side opening 34 of the coupler 30 and then into the side opening 29. The lower end 26 of the coupler 20 screws into the coupler 30 until the bent portion 44 of the spring clip 40 engages with the side opening 29 of the downrod 20. The clip 40 engages the downrod 20 preventing any further rotating movement of the downrod 20.

At this point, the downrod 20 and lower coupler 30 can then be securely fastened to the top of the ceiling fan motor 50 by an additional set screw/pin 39 that passes through a side hole 32 in the coupler 30 and side hole 27 in the downrod 20.

To separate the motor 50 from the downrod 20, the installer can remove the set screw/pin 39. Next, the bent portion 44 of the spring clip 40 can be disengaged by pulling on tab 42 and unscrewing the coupler 30 from the lower end 26 of the downrod 20 until the coupler 30 becomes separated from the motor 50.

While the drawings show the spring clip attached to the coupler to engage a side opening in the bottom of the downrod, the invention can be practiced where the spring clip is part of the bottom of the downrod which engages an opening in the coupler.

Although the novel coupler is shown attaching the motor to the bottom of the downrod. The coupler can be used to couple the top of the down rod to the ceiling mount portion.

Although the invention shows the novel coupler attached to a ceiling fan motor, the novel coupler can be used to attach other downwardly supported lights, and any other products that can attach to a downrod.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A downrod coupler system for ceiling fans, comprising:
a ceiling mount adapted to be attached to a ceiling;
a downrod having an upper end for being attached to the ceiling mount, and a bottom end, the downrod having a side external opening adjacent to the bottom end;
a ceiling fan having a motor;
a coupler having a socket portion for receiving the bottom end of the downrod, the coupler having a lower portion mounted to the motor, the coupler having a side through-hole, the coupler having an elongated vertical recess in a side wall of the coupler; and
a spring lock mechanism having a vertical leg attached along a side wall of the coupler and a bent portion extending into the side through-hole of the coupler, the elongated vertical recess for supporting the vertical leg of the spring clip, the bent portion for automatically locking the bottom end of the downrod to the ceiling fan motor when the bottom end of the downrod has been inserted into the socket portion of the coupler and the bent portion extends into both the side through-hole of the coupler and the side external opening of the downrod.

2. The downrod coupler system of claim 1, wherein bottom end of the downrod includes external threaded surface, and the socket portion has an internal threaded surface, wherein the external threads on the bottom end of the downrod mateably threads into the internal threaded surface of the socket portion of the coupler.

3. The downrod coupler system of claim 1, further comprising:

a set screw for further locking the downrod to the coupler.

4. A downrod coupler system of claim 1, wherein the coupler is bolted to the motor.

5. The downrod coupler system of claim 1, wherein the spring lock mechanism further includes:

a bent tab adjacent to the bent portion, the bent tab extending in a direction opposite to the bent portion.

6. A method of coupling a downrod to a motor mounted coupler without using cotter type pins, comprising the steps of:

mounting a ceiling mount to a ceiling;

providing a downrod with an upper end and a bottom end, the downrod having a side external opening adjacent to the bottom end;

providing a ceiling fan with a motor;

attaching the upper end of the downrod to the ceiling mount;

providing a coupler having a socket portion for receiving the bottom end of the downrod, and a side through-hole and an elongated vertical recess in a side wall of the coupler;

mounting a lower portion of the the coupler to the motor on the ceiling fan;

providing a spring clip with a vertical leg and a bent portion, the vertical leg of the spring clip being mounted in the elongated vertical recess along the side wall of the coupler, with the bent portion extending into the side through-hole of the coupler; and automatically attaching the coupler to the bottom end of the downrod after the bottom end of the downrod has been inserted into the socket portion of the coupler and the bent portion of the spring clip extends into both the side through-hole of the coupler and the side external opening of the downrod.

7. The method of claim 6, further comprising the steps of:

providing the bottom end of the downrod with an external threaded surface;

threadably attaching the bottom end of the downrod into the socket until the spring clip engages the side opening.

8. The method of claim 6, further comprising the step of:

providing a set pin member to lock the bottom of the downrod to the coupler.

9. The method of claim 6, wherein the step of providing a spring clip further includes the step of:

providing a bent tab adjacent to the bent portion, the bent tab extending in a direction opposite to the bent portion.

10. A ceiling attachment system, comprising:

a downrod having an upper end adaptable to be attached to a ceiling and a lower end, and having a side external opening adjacent to the bottom end;

a coupler having a socket portion for receiving the bottom end of the downrod, and the coupler having a lower portion mounted to the motor, the coupler having a side through-hole and the coupler having an elongated vertical recess in a side wall of the coupler; and a spring having a vertical leg attached in the elongated vertical recess in the side wall of the coupler and a bent portion extending into the side through-hole of the coupler, wherein the spring is used for automatically locking the downrod to the coupler when the lower end of the downrod is inserted into the socket portion of the coupler and the bent portion of the spring extends into both the side through-hole of the coupler and the side external opening of the downrod.

11. The ceiling attachment system of claim 10, further includes a ceiling fan attached to the coupler.

12. The ceiling attachment system of claim 10, further includes a light attached to the coupler.

13. The ceiling attachment system of claim 10, wherein the spring further includes:

a bent tab adjacent to the bent portion, the bent tab extending in a direction opposite to the bent portion.

* * * * *